United States Patent [19]

Coates

[11] Patent Number: 4,643,451

[45] Date of Patent: Feb. 17, 1987

[54] ENVELOPE FOR RECEIVING A PLURALITY OF COUPONS OR PROMOTIONAL VOUCHERS

[75] Inventor: Derek Coates, Penn, England

[73] Assignee: Holmes & Marchant Promotions, Limited, Buckinghamshire, England

[21] Appl. No.: 729,478

[22] Filed: May 1, 1985

[51] Int. Cl.[4] ..... G09F 1/00; B41L 1/20; B41L 43/00; G09D 3/02

[52] U.S. Cl. ..... 283/56; 282/11.5 R; 282/25; 40/122

[58] Field of Search ..... 282/25, 11.5 R; 283/56, 283/1 B, 51; 281/31; 40/122; 206/37, 37.4, 39, 39.1; 229/68 R, 76; 156/441.5; 493/186

[56] References Cited

U.S. PATENT DOCUMENTS

| | | | |
|---|---|---|---|
| 1,764,569 | 6/1930 | Knee | 282/11.5 R |
| 2,154,736 | 4/1939 | Endres | 282/25 |
| 2,181,212 | 11/1939 | Smith | 282/11.5 R |
| 3,032,904 | 5/1962 | Washburn . | |
| 3,104,799 | 9/1963 | Steidinger | 282/25 |
| 3,696,532 | 10/1972 | Mahon | 40/122 |
| 4,237,947 | 12/1980 | Mater . | |
| 4,305,605 | 12/1981 | Vine | 283/56 |
| 4,307,900 | 12/1981 | Krautsack . | |
| 4,313,557 | 2/1982 | Foffel | 283/56 |

FOREIGN PATENT DOCUMENTS

| | | | |
|---|---|---|---|
| 85091 | 5/1920 | Switzerland | 40/122 |
| 0340669 | 1/1931 | United Kingdom . | |
| 0530555 | 12/1940 | United Kingdom . | |
| 0880207 | 10/1961 | United Kingdom . | |
| 1000871 | 8/1965 | United Kingdom . | |
| 1027917 | 4/1966 | United Kingdom . | |
| 1038621 | 8/1966 | United Kingdom . | |
| 1127322 | 9/1968 | United Kingdom . | |
| 1540539 | 2/1979 | United Kingdom . | |
| 2113611 | 8/1983 | United Kingdom . | |

*Primary Examiner*—Paul A. Bell
*Assistant Examiner*—Paul M. Heyrana, Sr.
*Attorney, Agent, or Firm*—Sandler & Greenblum

[57] ABSTRACT

Voucher or coupon facilitating promotion of consumer goods comprises a sheet of stiff paper 1 perforated at 2 and with a fold line at 3 defining a margin adhesive-coated at 8. A transparent film is adhered around its edges 4 and 5, and across its width at 6, to define transparent pockets 7, open at 8, and longer than the adhesive coated margin is wide. Promotional literature and consumer instructions connected with "proof-of-sale" labels or tokens can be printed at the optional tear-off region 9, a mailback address or supermarket instruction can be printed on the back. The sheet can be used to amass and display, e.g. label portions and folded into a redemption voucher with consequent improved convenience in handling for consumer, store, or handling agent.

12 Claims, 6 Drawing Figures

Figure 1:
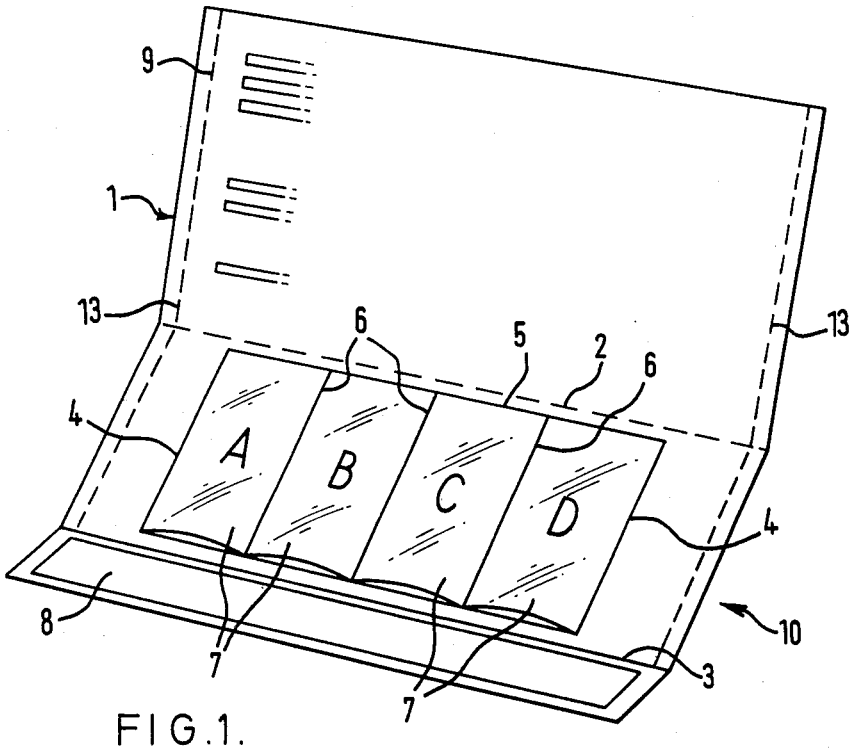

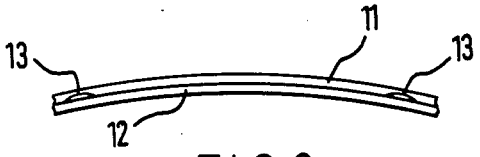
FIG.3a.
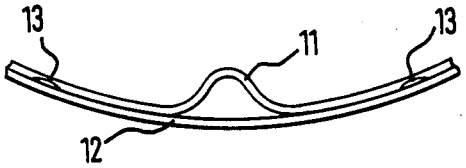
FIG.3b.
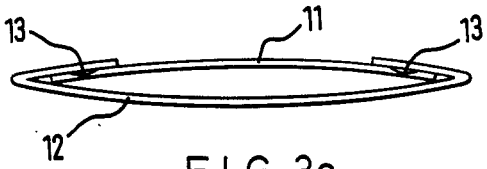
FIG.3c.
FIG.4.
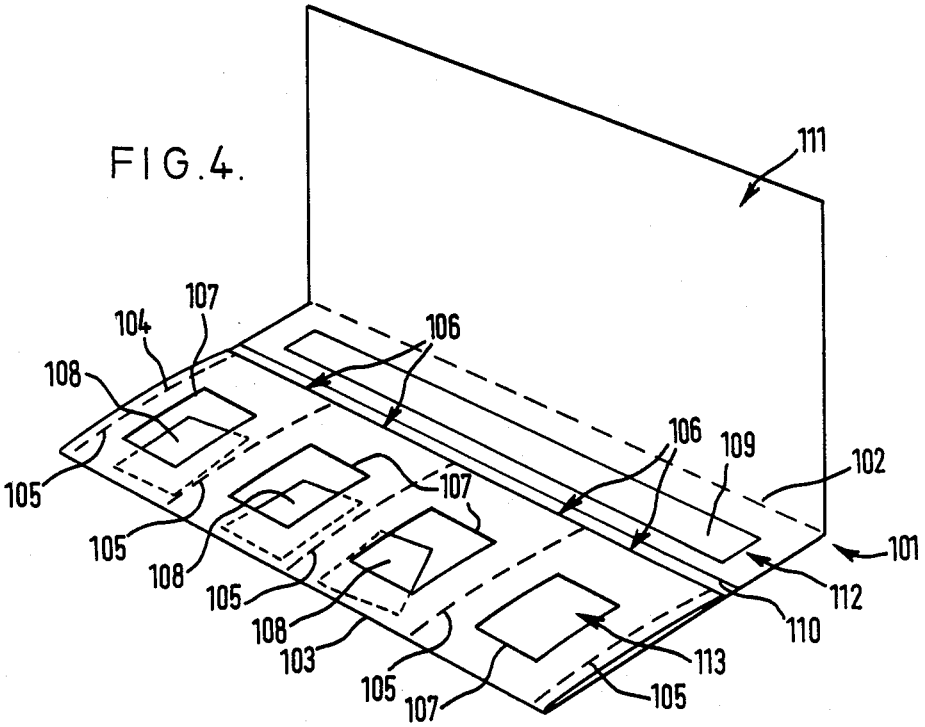

ENVELOPE FOR RECEIVING A PLURALITY OF COUPONS OR PROMOTIONAL VOUCHERS

This invention relates to marketing of foodstuffs and consumer goods and provides a novel form of promotional coupon or voucher to promote such marketing.

It is commonplace to provide vouchers which can be used to promote sales of a particular brand of merchandise. Such vouchers can for example be printed in newspapers provided by a direct mailing of advertisement, or feature as part of a label on an earlier purchase of the same or related goods. The effectiveness of such vouchers, however, is only as great as the care taken at the point of exchange. At busy times, or with lax control it is common for a number of assorted vouchers to be handed over, and accepted, as part of a larger transation rather than in part exchange for specified goods. This is clearly undesirable for the manufacturer, who is moreover not usually in a position to insist on control conditions which the stores find unduly onerous.

Because of this, the provision of a "proof-of-sale" voucher has also been commonly used. This has however, practical difficulties. Usually, it comprises the whole or part of a label of the goods. The handling by a supermarket, or handling house, in bulk, of such small and variously shaped paper labels is again onerous and can give rise to fraud. The alternative, of having the consumer return the voucher directly to the handling agent for a refund is not attractive unless the voucher is individually large since on the one hand the customer is not attracted while on the other the promoter finds costs of postage and handling to be a burden.

We have realised that there is a need for some form of coupon or voucher which facilitates handling of these "proof-of-sale" tokens or labels.

The present invention is based on the observations that the tokens are usually small, sometimes irregular, flimsy slips of paper, and provides a minimal envelope or pocket on a standard voucher for containment of such token.

In one aspect the invention consists in a promotional coupon or voucher, consisting of (a) a first sheet of paper or card with an overall dimension between 2.5 and 6 inches (63 and 153 mm) and the overall dimension at right angles thereto between 1.25 and 3.5 (32 and 89 mm), having on a first surface a body of printed information, this first sheet extending in all directions at least up to the edges of (b) a second sheet portion not larger than the first sheet and secured flat against the other surface thereof by continuous or discontinuous lines of adhesive located directly between the adjacent faces of the two sheets at least at or near edges of the second sheet portion to define at least one open pocket; the second surface of the first sheet having printing or other indicia to indicate the location of the opening of, and/or the function of, the pocket or pockets, the second sheet portion being such as to leave the pocket contents visible.

The "see-through" sheet portion may involve translucent or transparent materials e.g. "Glassine" paper or transparent polymer foil. As a further example of such a "see-through" characteristic, a sheet of material not in itself transparent, but provided with suitable apertures, can be used.

The apertures can be an expanse of small perforations, giving a mesh-like appearance. They can alternatively be a few adjacent circular holes, e.g. as used in paypackets or like money-handling envelopes. They may also be a single open window for each pocket; in such a case the lines of adhesion, and pocket size thereby defined will be such as not to permit a pocketed "proof of sale" to slip into, and be non-visible in, a covered edge or corner.

The second sheet portion with apertures can be a separate sheet or a folded part of the same material as the first sheet.

Such an article is different from the usual envelope construction in respects particularly suited to its proposed use. Known constructions of envelope, where one wall may be orificed or partially transparent typically fold over the margins of one sheet to cover, and to be adhered to, the margins of the other. This is an expensive construction if a print run of millions is envisaged. Also, there is a tendency in use for the turned over margins to lift the secondary sheet away from flat contact. In the present invention, however, a see-through sheet portion is adhered, around most of its edges at least, flat face-to-face on the main sheet. This is a cheap construction and ensures that, in use, a slip of paper or like token in the pocket is always gripped and does not fall out of the opening under normal conditions of handling. Also, since the see-through sheet portion is not larger than the main sheet, and adheres substantially at its edges, it can be handled as a standard-size voucher by supermarkets and handling houses.

Since more than one pocket is easily and cheaply fabricated by suitable lines of adhesives, the invention permits gradual accumulation of tokens, e.g. across a range of products, without loss and with constant visibility through the walls of each pocket. Also, supermarket instructions in the agreed voluntary format can figure on the other side of the main sheet and consumer instructions on the pocketed side.

A typical preferred voucher according to the invention will be rectangular, from 3.5 to 5 inches (89 to 127 mm) long and from 1.75 to 2.75 (44 to 70 mm) wide. From one to eight pockets, preferably from two to six pockets may be defined.

As explained above, the construction gives adequate retention to slips of paper or like tokens, e.g. over a period of gradual build-up by the housewife. However, for redemption and despatch and to avoid argument and fraud, it is preferred to close the pockets. It is accordingly valuable to provide a fold indication printed on the first sheet, or a fold line scored or creased into the first sheet, passing close to, or immediately at the opening of at least one pocket and defining with an adjacent first sheet edge a marginal region narrower than the pocket depth from the opening, the marginal regions being adhesive-coated whereby upon folding the first sheet along the fold line the pocket can be sealed with contents still visible.

Usually, the sheet will be rectangular and the fold line parallel to a longer edge, to define a margin foldable over the mouth or mouths of one or more of the pockets defined by the adhesion lines between the see-through sheet portion and the first sheet. The pockets should not be obscured when the adhesive margin is folded over; we have found that they should be preferably from 3 to 10 times as long as this margin is wide.

It will be found valuable e.g. for instructions and advertising copy also to provide the sheet with a tear-off portion. This can for example extend beyond the inner (i.e. adhered) edge of the see-through portion. It can be defined by a score line, perforations, or the like, parallel to the fold line. Consumer instructions or promotional wording can in such case be printed on the tear-off portion, on the same face as the see-through portion; it is valuable to separate such instructions from supermarket instructions or promotional wording (or a mail-back address) printed on the rear face of the sheet i.e. between the tear-off portion and the fold line If desired, printed matter can be visible through the see-through second sheet portion.

In a practical embodiment therefore the invention provides a promotional coupon or voucher constituted by a rectangular sheet of paper having (i) a line of perforations parallel to the short edges, (ii) a fold line parallel to the short edges, (iii) a rectangular sheet portion adhered around its edges except at an edge parallel to the fold line and being further adhered at lines at right angles to the fold line to define pockets (iv) a layer of adhesive on the sheet on the same face as the rectangular sheet portion, (v) consumer instructions or promotional literature printed on the same face as the rectangular sheet portion and (vi) handling instructions printed on the reverse face of the sheet between the perforations and the fold line: wherein the rectangular sheet portionis such as to leave the pocket contents visible.

The rectangular sheet portion can itself be a folded-over end of the total sheet (provided with the apertures, as discussed above) and folded about the "fold line", and the adhesive can be provided between the perforations and the free pocket edge, for folding over the filled pockets.

In another valuable embodiment the invention provides a promotional coupon or voucher constituted by a rectangular sheet of paper having (i) a line of perforations parallel to the short edges and substantially halfway along its length (ii) a fold line parallel to and near to one short edge (iii) a rectangle of transparent film adhered to the sheet, between the perforations and the fold line, being adhered around its edges except at an edge adjacent to and parallel to the fold, and being further adhered at lines at right angles to the fold line to define pockets (iv) a layer of adhesive between the fold line and its adjacent shorter sheet edge, on the same face as the transparent film (v) consumer instructions or promotional literature printed on the other side of the perforations and on the same face as, the transparent film and (vi) handling instructions printed on the reverse face of the sheet between the perforations and fold line.

In other words, pockets may be filled from the outer edge or the inner edge, closest the perforations. Other variants (two rows of pockets, slits in pocket walls) are also possible.

For initial voucher distribution, the composite is robust enough that it can be provided with one or more lines of adhesive whereby it can be fixed to packaging or promotional literature for initial distribution.

These can be lines of adhesive on the first or second surface of the first sheet.

Figure 2:
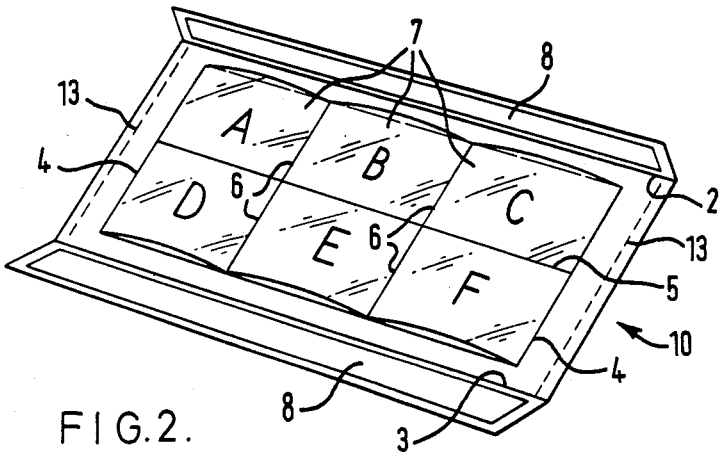

The invention will be further described with reference to the accompanying drawings in which:

FIG. 1 is a perspective view of one example of a coupon or voucher according to the invention, FIG. 2 is a perspective view of a different embodiment, FIGS. 3*a* to 3*c* are diagrams indicating possible flexure of the coupon, and FIG. 4 shows in perspective view a yet further embodiment according to the invention.

The article shown in FIG. 1 consists of a sheet of stiff paper or card 1 with a perforation or score line at 2 and a fold line at 3. Between the perforation or score line 2 and fold line 3 is adhered a sheet of transparent material e.g. polymeric film or regenerated cellulose. Typically, the film will be adhered at its edges 4, long edge 5, and intermediate lines 6 so as to define a number of elongate transparent pockets 7, open at their end nearest fold line 3. (The extent of opening is exaggerated in the drawing; in practice the pockets are effectively flat). A strip 8 of water-soluble or pressure sensitive adhesive is provided between fold line 3 and the adjacent edge.

As shown, the upper portion of the article at 9 can contain printed instructions and/or promotional wording. At the rear face (not shown) of the article, behind the region of the pockets 7 and where indicated by the arrow 10, further instructions by the supermarket, or possibly a mail-back address, optionally pre-paid, can be printed. Printing, indicating for instance the required tokens, can also be provided at A, B, C and D beneath the pockets.

In use, the article is supplied free e.g. as a leaflet or in a promotional mailing. Instructions on the use for the customer are printed at 9, i.e. separately from any supermarket instructions overleaf at 10. The larger size gives room for useful promotional wording or artwork. The pockets can retain, in the example shown, up to four labels of the same or different sorts, one in each pocket. When full, the top portion is torn off at 2, and the adhesive flap is foled over at 3. The voucher can now be redeemed at a supermarket or by mail.

Many advantages flow from this configuration of article.

The use of pockets immobilises the enclosed label. The housewife can retain the card prominently and over a period of time builds up the requisite number of labels, etc. Also, the supermarket only has to handle simple rectangular units of clear and immediate significance. High-value vouchers can be conveniently built up and handled e.g. by slowly amassing all of a set of labels, or by using only a very specialised small part of the label (thereby to discourage casual supermarket fraud). The handling agent can readily check, retain and collate the results of a campaign. If desired, the card can be printed with comparison units, under the transparent pockets to discourage fraud and argument. Also, the same format can be adopted to different campaigns and any number of "pockets" e.g. from 1 to 20 or more could be envisaged. Possibly, the item returned need not be of paper but could be e.g. a promotional tassel or thread.

In a typical promotional use, the coupon or voucher is printed with a face value, but redeemable only if the pocket or pockets are properly filled with the specified "proofs of purchase". Thus the voucher is free from risk of fraud at point of issue and point of redemption; in the first instance no "proofs of purchase" are included, and in the second these proofs of purchase are typically sealed in.

An alternative configuration is shown in FIG. 2. Like reference numerals indicate like features to those of FIG. 1. In this instance, no tear-off portions ar provided, but the lines of adhesive 4, 5, 6 are such that six pockets 7 are defined for tokens A–F, as printed beneath the film. Two fold lines 3 define two margins adhesively coated as at 8 to seal the filled pockets 7.

The nature of the adhesive used is widely variable but normal considerations, known to those skilled in the art, will apply. Thus, for the lines of adhesive at 4, 5 and 6 any adhesive material capable of being printed in lines or rows of dots, and adhesive both to paper and to polymer, regenerated cellulose or like films (e.g. "Glassine" paper) could be used. The width of individual lines of adhesive does not appear to be critical. Heat-welding or solvent welding of polymer film could be used.

The adhesive used at the folded marginal areas is preferably a watersoluble adhesive. e.g. as in a conventional envelope. If so, the preferred film is of "Glassine" paper, for better adhesion, although the configuration of the coupon and in particular the available paper-to-paper adhesion on folding will often permit the use of other types of film. Pressure-sensitive adhesives are technically possible but expensive.

FIGS. 3*a* and 3*b* and 3*c* shows a phenomenon we have observed which it is believed may contribute to the effectiveness of this although we do not intend our invention to be limited in any such theory of operation. The film 11 is stuck flat on the paper 12 by adhesive 13. If this composite is flexed as at FIG. 3*a*, the film stays in contact with the paper, thus retaining a flimsy contained token (not shown). If the composie is flexed the other way we have observed that the film tends not to lift completely but only as shown. Thus, the token is still retained. A prior art envelope e.g. at 3*c* with overlapped edges would tend to lift its top layer and thus lose the token unless the end was closed.

FIGS 1 and 2 additionally show possible locations for lines of adhesive at 13. These could be used for initial attachment to packaging i.e. for initial distribution. Like lines could alternatively be provided on surface 10.

In FIG. 4, a sheet of paper 101 has a tear-line of perforations 102 and a fold line 103 about which a flap 104 is folded back and adhered at lines 105 to define pockets 106. Rectangular apertures 107 are provided, one to each defined pocket, to allow the contents 108 to be visible, the lines 105 of adhesive being so positioned relative to the apertures 107 that the contents are not obscured, and the apertures being too small for the contents to fall out.

A layer 109 of adhesive extends across the sheet at the mouths of the pockets. A subsidiary fold line 110 can be provided if desire.

Consumer instructions can be printed at 111, 112 or 113. Advertising material and/or handling (i.e. shop) instructions and conditions can be printed on the reverse side, not shown.

The voucher can be made by simple printing, adhesive application, aperturing and folding at 103. The voucher is used for filling the pockets as instructed, tearing at 102, and folding over the resulting end flap at 110 so that the pockets are closed.

I claim:

1. A blank foldable into an envelope for retaining promotional and advertising proof-of-purchase tokens, said envelope comprising:

(a) a first substantially rectangular paper or board panel having first and second surfaces, advertising indicia being printed on said first surface, and different printed indicia being printed on a second surface of said first panel;

(b) a second substantially rectangular panel having dimensions no larger than the dimension of said first panel, said second panel being integrally attached to said first panel by a fold line, said second panel being foldable over said first surface of said first panel into a flat position in which said first and second panels are secured by a plurality of parallel adhesive lines, at least one additional line of adhesive being positioned substantially perpendicularly to said parallel lines of adhesive to define at least two pockets with open ends for receiving tokens, coupons or vouchers, said second panel comprising means for viewing the contents of both of said pockets, said content viewing means comprising apertures in each of said pockets; and (c) said second surface of said first panel having an additional adhesive coating positioned on a portion of said first panel adjacent to said open end of each of said pockets, said additional adhesive coating comprising means for closing said pockets when said first panel portion is folded over said pocket open ends, so that when said first panel is folded over said second panel and said pocket open ends are closed, said envelope comprises a substantially rectangular voucher adapted to be redeemed, said sealed envelope having a length between 2.5 and 6 inches and a width between 1.25 and 3.5 inches.

2. A blank foldable into an envelope for retaining promotional and advertising proof-of-purchase tokens, said envelope comprising:

(a) a first substantially rectangular paper or board panel having first and second surfaces, advertising indicia being printed on said first surface, and different printed indicia being printed on a second surface of said first panel;

(b) a second substantially rectangular panel having dimensions no larger than the dimensions of said first panel, said second panel being secured in a substantially flat fashion against said second surface of said first panel by a plurality of parallel lines of adhesive material positioned between said second surface of said first panel and a first surface of said second panel, at least one additional line of adhesive being positioned substantially perpendicularly to said prallel lines of adhesive to define at least two pockets for receiving individual tokens, coupons or vouchers, each of said pockets having an open end, said second panel comprising means for viewing the contents of said pockets; and (c) said second surface of said first panel having an additional adhesive coating positioned on a portion of said first panel adjacent to said open ends of said pockets, said additional adhesive coating comprising means for closing said pockets when said portion is folded over said pocket open ends so that when said first panel is folded over said second panel and said pocket open ends are closed, said envelope comprises a substantially rectangular voucher adapted to be redeemed, said sealed envelope having a length between 2.5 and 6 inches and a width between 1.25 and 3.5 inches.

3. An evelope in accordance with claim 2 wherein said second panel is formed from a separate sheet than first panel and comprises transparent material, translucent, material or opaque material having a plurality of windows.

4. An envelope formed in accordance with claim 3 wherein said at least one additional line of adhesive positioned perpendicularly to said parallel lines of adhesive is located adjacent one edge of said second panel to define a plurality of open pockets having open ends all facing in a single direction.

5. An envelope formed in accordance with claim 3 wherein said at least one additional line of adhesive is positioned perpendicularly to said parallel lines of adhesive and is located along a central portion of said second panel to define two sets of open pockets facing in opposite directions.

6. An envelope formed in accordance with any one of claims 2–5 wherein said first panel includes means for separating said panel into a main first panel portion and a sealing flap, said flap portion having a width less than the depth of said pockets, so that when said flap is folded over said pocket open ends said contents of said pockets remains visible.

7. An envelope formed in accordance with claim 6 wherein the depth of each of said pockets is between 3 and 10 times the width of said sealing flap.

8. An envelope formed in accordance with any of claims 2–wherein said first panel comprises at least two portions, a main panel portion and a separable portion, said two panel portions being separated by a weakened line, a score line, or a line of perforations.

9. An envelope in accordance with any of claims 2–5 wherein said first panel comprises a main panel portion and at least two other portions foldably connected to said main panel portion by opposed fold lines, said parallel lines of adhesive extending along said main panel portion and between said fold lines, wherein said pockets have a plurality of open ends adjacent to each of said fold lines.

10. A foldable envelope adapted to retain a plurality of coupons, vouchers or advertisements, said envelope comprising:

(a) a first substantially rectangular panel, a second substantially rectangular panel attached to said first panel along one side of said first panel by a first fold line, and a flap portion attached to a second side of said first panel by a second fold line;

(b) a substantially transparent sheet attached to one face of said main panel, said substantially transparent sheet being substantially rectangular and adhered to said face of said first panel by a plurality of parallel lines of adhesive and one additional line of adhesive perpendicular to said parallel lines and located along only one edge of said transparent sheet to define a plurality of pockets with open ends located between said transparent sheet and said said first panel; and (c) an adhesive area located along a major portion of said flap, so that when said flap is folded over said first panel it becomes adhesively secured to said pocket open ends to close said pockets.

11. A foldable envelope adapted to retain a plurality of coupons, vouchers or advertisements, said envelope comprising:

(a) a first substantially rectangular panel, a second substantially rectangular panel attached to said first panel along one side of said first panel by a first fold line, and a flap attached to a second side of said first panel by a second fold line;

(b) a substantially transparent sheet attached to one face of said main panel portion, said substantially transparent sheet being substantially rectangular and adhered to said face of said first panel by a plurality of parallel lines of adhesive and one additional line of adhesive a central portion of said transparent sheet, said additional line being perpendicular to said parallel lines and said sheet being otherwise unattached to said first panel to define a plurality of open-ended pockets between said transparent sheet and said first panel; and (c) an adhesive area located along a major portion of said flap, so that when said flap is folded over said first panel it becomes adhesively secured to said pocket open ends to close said pockets.

12. An envelope adapted to retain a plurality of coupons, vouchers or other advertisements in a plurality of substantially parallel pockets, said envelope comprising:

(a) a substantially rectangular first panel having first and second opposed sides and first and second opposed ends;

(b) a flap attached by a first fold line to said first side of said first panel, said flap being coated with adhesive along one surface thereof;

(c) a second panel attached by a weakened line to an edge of said adhesive coated flap, said edge being opposite from and substantially parallel to said first fold line; and (d) a third panel attached to said second side of said first panel by a second fold line, said second panel adapted to be folded over said first panel and to be attached to said first panel by a plurality of parallel lines of adhesive, at least two of said adhesive lines being positioned substantially adjacent to and parallel with said first and second ends of said first panel, so that when said third panel is folded over said first panel, said adhesive lines serve to define a plurality of pockets with open ends said first fold line, wherein said pockets are adapted to be closed by folding said adhesively coated flap over said folded third panel, said third panel having a plurality of apertures comprising means for viewing the contents of said pockets.

* * * * *

UNITED STATES PATENT AND TRADEMARK OFFICE

CERTIFICATE OF CORRECTION

PATENT NO. : 4,643,451

DATED : February 17, 1987

INVENTOR(S) : D. COATES

It is certified that error appears in the above-identified patent and that said Letters Patent is hereby corrected as shown below:

At column 1, line 34, "realised" should read ---realized---;

At column 3, line 24, "portionis" should read ---portion is ---;

At column 4, line 36, "immobilises" should read ---immobilizes---;

At column 4, line 43, "specialised" should read ---specialized---;

At column 4, line 64, "ar" should read --are--;

At column 5, line 26, "composie" should read ---composite ---;

At column 6, line 43 (i.e., claim 2, line 18), "prallel" should read ---parallel---; and At column 7, line 21 (i.e., claim 8, line 2), "2-wherein" should read ---2-5 wherein---.

Signed and Sealed this

Fifth Day of January, 1988

*Attest:*

*Attesting Officer*

DONALD J. QUIGG

*Commissioner of Patents and Trademarks*